US005873387A

United States Patent [19]

Weber et al.

[11] Patent Number: 5,873,387

[45] Date of Patent: Feb. 23, 1999

[54] HIGH ARC SPOUT RADIAL MOVEMENT RETAINER

[75] Inventors: Eric M. Weber, Medina; Mark C. Fenn, Akron, both of Ohio

[73] Assignee: Moen Incorporated, North Olmsted, Ohio

[21] Appl. No.: 951,582

[22] Filed: Oct. 16, 1997

[51] Int. Cl.[6] ..... E03C 1/04

[52] U.S. Cl. ..... 137/615; 4/678; 137/801; 285/276

[58] Field of Search ..... 173/615, 801; 4/677, 678; 285/276

[56] References Cited

U.S. PATENT DOCUMENTS

| | | | |
|---|---|---|---|
| 4,037,624 | 7/1977 | Turner et al. | 137/615 |
| 4,456,287 | 6/1984 | Bisonaya | 137/615 X |
| 4,592,388 | 6/1986 | Wilcox . | |
| 4,976,287 | 12/1990 | Sheen . | |
| 4,997,008 | 3/1991 | Zbin | 137/615 X |
| 4,998,555 | 3/1991 | Barhydt, Sr. et al. . | |
| 5,148,832 | 9/1992 | Lin . | |
| 5,301,715 | 4/1994 | Becker . | |
| 5,381,830 | 1/1995 | Niemann et al. . | |
| 5,458,154 | 10/1995 | Niemann et al. . | |
| 5,464,045 | 11/1995 | Niemann et al. . | |

FOREIGN PATENT DOCUMENTS

| | | | |
|---|---|---|---|
| 2064045 | 6/1981 | United Kingdom | 4/678 |

*Primary Examiner*—Gerald A. Michalsky
*Attorney, Agent, or Firm*—Dorn, McEachran, Jambor & Keating

[57] ABSTRACT

A faucet spout mounting assembly includes a spout having an elongated tubular portion. There is a spout hub having a cavity, with an end of the spout tubular portion being positioned within the cavity and rotatable relative thereto. There is a water passage in the hub communicating with the cavity. The spout hub has exterior threads thereon and there is a spout nut threadedly engaging the spout hub and extending along the spout elongated tubular portion and beyond the spout hub. There is a recess in the spout nut facing the spout elongated tubular portion and a spring member is positioned within that recess. The spring member has spaced portions thereon, some of which bear against the spout nut and some of which bear against the spout elongated tubular portion, to thereby restrain radial movement between the spout and the spout nut while providing no essential increase in resistance to rotary movement of the spout.

7 Claims, 1 Drawing Sheet

HIGH ARC SPOUT RADIAL MOVEMENT RETAINER

THE FIELD OF THE INVENTION

The present invention relates to faucet spouts, and more particularly to kitchen spouts, and specifically those kitchen spouts known as high arc spouts in which the spout extends a substantial distance upwardly above the sink deck. Such spouts are not limited to use in the kitchen and may find utility as bar faucets and occasionally in the lavatory. Because the spouts extend such a substantial distance above the mounting for the spout to the sink deck, there has in the past been radial movement of the spout relative to the spout mounting system which gives the user the impression that the product is inadequate or poorly engineered. The present invention provides a spring retainer for preventing radial movement between the spout and its mounting assembly while yet providing no essential increase in resistance to rotary movement of the spout.

SUMMARY OF THE INVENTION

The present invention relates to high arc spouts of the type commonly found in a kitchen environment and more particularly to a means for eliminating radial movement between such a spout and the spout mounting assembly.

A primary purpose of the invention is a high arc spout mounting assembly which includes a spring positioned between the spout and the mounting assembly, which spring restrains radial movement between the spout and the mounting assembly while providing no essential increase in resistance to rotary movement of the spout.

Another purpose of the invention is to provide a spout and mounting assembly as described utilizing a ringlike spring having surfaces thereon which bear against both the spout and the spout mounting assembly.

Another purpose is a simply constructed reliable spout mounting assembly which eliminates radial movement between the spout and the mounting assembly while providing no increase in resistance to spout radial movement.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figures 1, 2, 3, 4:
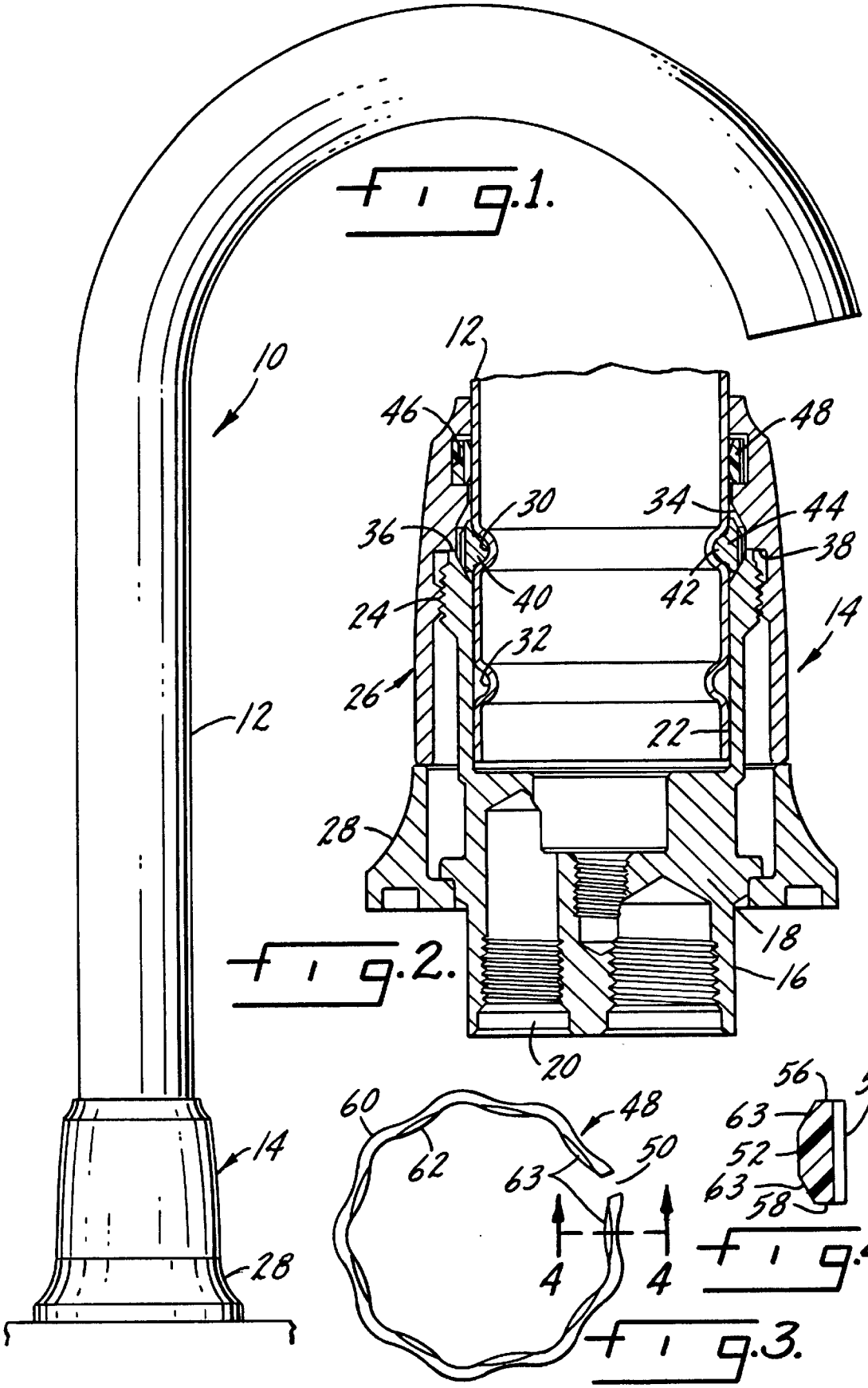
FIG. 1 is a side view of a high arc spout positioned within the mounting assembly of the present invention.
FIG. 2 is an enlarged vertical section through the spout mounting assembly.
FIG. 3 is a plan view of the spring positioned between the spout and the spout nut.
FIG. 4 is a section along plane 4—4 of FIG. 3.

High arc spouts are customarily found in the kitchen, but also may be found in the bathroom as lavatory spouts and may also be used as spouts for bar sinks. Such high arc spouts have a distinctive appearance and are particularly desirable in the kitchen as they provide substantial space beneath the discharge end of the spout to rinse large objects such as pots and pans. In the past, such high arc spouts have wobbled or moved radially within their mounting assemblies. This has been perceived by the user as an imperfection in the spout or as a poor quality product. The present invention is specifically directed to a restraint on such radial movement and such a restraint which will not essentially increase the resistance to rotary movement of the spout.

In FIG. 1 the spout is indicated generally at 10 and has an elongated tubular portion 12 which extends vertically upward from a spout mounting assembly indicated generally at 14.

The spout mounting assembly 14 is shown specifically in FIG. 2. A spout hub 16 has a body portion 18 and a water passage 20. The passage 20 opens into a cavity 22 within the spout hub. An upper portion of the spout hub 16 has exterior threads 24 for use in mounting a spout nut indicated generally at 26. The spout nut will conventionally have a decorative exterior and the lower end of the spout nut will closely abut an escutcheon 28.

The elongated tubular portion 12 of the spout 10 is positioned within the cavity 22 and may have a pair of annular indentations or recesses 30 and 32. The use of two such recesses provides for using the same spout in different mounting assemblies. There is a cavity 34 formed at the junction between the upper end 36 of the spout hub and a surface 38 of the spout nut.

Within the cavity 34 there is positioned a retaining ring 40 which has an annular nose 42 which extends within the indentation 30 and a body portion 44 which is located within the cavity 34. The retaining ring 40 will hold the spout within the spout mounting assembly 12.

There is a further recess 46 formed in the spout nut near its upper end. Positioned within the recess 46 is a spring 48 shown in detail in FIGS. 3 and 4. The spring 48 has a wavelike horizontal cross section as shown in FIG. 3 and is a discontinuous ring, there being a gap 50 between opposing ends of the ring. In vertical cross section, the spring 48 has a somewhat trapezoidal configuration, there being an interior side wall 52, an exterior side wall 54 and a top 56 and a bottom 58. The effect of the wavelike cross section of the spring is to provide interior and exterior bearing points. The exterior bearing points are indicated at 60 with the interior bearing points being indicated at 62 in FIG. 3. The spring 48 has chamfered surfaces 63 on either side which enable the spring to be compressed during assembly of the spout. Having chamfered surfaces on both sides makes spring orientation unimportant. When the spring is positioned within the cavity 46, it will be under compression and thus the exterior bearing points 60 will bear fly against the wall of the cavity 46. Likewise, the interior bearing points 62 will bear firmly against the exterior of the spout. The spring thus provides restraint prohibiting radial movement between the spout and the spout nut. Since the spring only contacts the spout nut and the spout at spaced points, there is no essential increase in resistance to the customary rotary movement of the spout which is found in kitchen faucet assemblies.

The spring provides the described restraint against radial movement and will function with spouts having all types of exterior finish, whether it be painted or chrome.

Whereas the preferred form of the invention has been shown and described herein, it should be realized that there may be many modifications, substitutions and alterations thereto.

We claim:

1. A faucet spout mounting assembly including a spout having an elongated tubular portion, a spout hub having a cavity, an end of said spout tubular portion being positioned within said cavity and rotatable relative thereto, water passage means in said hub communicating with said cavity and said spout, said spout hub having exterior threaded means thereon, a spout nut threadedly engaging said spout hub and extending along said spout elongated tubular portion and beyond said spout hub, a recess in said spout nut facing said spout elongated tubular portion, and a spring member positioned within said recess and having spaced portions thereon, which extend both radially inward and radially outward, said radially outwardly extending spaced portions bearing against said spout nut and said radially inwardly extending portions bearing against said spout elongated tubular portion to thereby restrain radial movement between said spout nut and said spout while providing no essential increase in resistance to rotary movement of said spout.

2. The faucet spout mounting assembly of claim 1 wherein said spring member is generally ring-shaped.

3. The faucet spout mounting assembly of claim 2 wherein said ring-shaped spring member is discontinuous.

4. The faucet spout mounting assembly of claim 1 wherein the spring member spaced portions which extend radially inward are spaced between the spring member spaced portions which extend radially outward.

5. The faucet spout mounting assembly of claim 4 wherein said spring member has a wavelike cross section.

6. The faucet spout mounting assembly of claim 1 including a groove in said spout elongated tubular portion, and a retaining ring held between said spout hub and said spout nut and extending into said spout elongated tubular portion groove.

7. The faucet spout mounting assembly of claim 6 including a recess formed at a boundary of said spout nut and said spout hub, with said retaining ring being positioned in part within said boundary recess.

* * * * *